US007570161B2

(12) United States Patent
Necchi

(10) Patent No.: US 7,570,161 B2
(45) Date of Patent: Aug. 4, 2009

(54) ANTI-THEFT AND SAFETY MECHANISM FOR BOTTLES

(76) Inventor: Pietro Necchi, Via Dante 7, Borgoratto Alessandrino (IT) I-15013

( * ) Notice: Subject to any disclaimer, the term of this patent is extended or adjusted under 35 U.S.C. 154(b) by 390 days.

(21) Appl. No.: 11/573,972

(22) PCT Filed: Sep. 22, 2004

(86) PCT No.: PCT/IT2004/000516

§ 371 (c)(1),
(2), (4) Date: Feb. 20, 2007

(87) PCT Pub. No.: WO2006/033124

PCT Pub. Date: Mar. 30, 2006

(65) Prior Publication Data

US 2008/0156764 A1 Jul. 3, 2008

(51) Int. Cl.
*G08B 13/14* (2006.01)

(52) U.S. Cl. ..... 340/568.1; 340/539.1; 340/541; 340/542; 340/571; 340/825.69; 215/201; 215/212; 215/279

(58) Field of Classification Search ..... 340/568.1, 340/541, 542, 539.1, 571, 825.69; 215/201, 215/212, 274, 279; 70/57.1, 58, 166, 312
See application file for complete search history.

(56) References Cited

U.S. PATENT DOCUMENTS

| | | | | |
|---|---|---|---|---|
| 3,598,284 | A * | 8/1971 | Wessely | 222/18 |
| 5,602,530 | A | 2/1997 | Holmgren | |
| 5,957,313 | A | 9/1999 | Bouan | |
| 6,912,878 | B2 * | 7/2005 | Belden, Jr. | 70/57.1 |
| 7,259,674 | B2 * | 8/2007 | Marsilio et al. | 340/572.1 |

FOREIGN PATENT DOCUMENTS

WO WO 99/67149 A1 12/1999

OTHER PUBLICATIONS

International Search Report issued on Apr. 1, 2005 for PCT/IT2004/000516.

* cited by examiner

*Primary Examiner*—Hung T. Nguyen
(74) *Attorney, Agent, or Firm*—David A. Farah; Sheldon Mak Rose & Anderson PC

(57) ABSTRACT

An anti-theft and safety mechanism (1) for bottles is disclosed, comprising an external support body (2), locking and unlocking means of this mechanism (1) and means for securing this mechanism (1) onto a neck of a bottle.

7 Claims, 4 Drawing Sheets

ANTI-THEFT AND SAFETY MECHANISM FOR BOTTLES

CROSS-REFERENCE TO RELATED APPLICATION

The present Application is a 371 of International Patent Application No. PCT/IT2004/000516, titled "Anti-Theft and Safety Mechanism for Bottles" filed Sep. 22, 2004, the contents of which are incorporated in this disclosure by reference in their entirety.

BACKGROUND

1. Field of the Invention

The present invention refers to an anti-theft and safety mechanism for bottles.

2. Background of the Invention

As known, the prior art proposes anti-theft mechanisms, typically operating magnetically, adapted to contain therein and protect objects such as, but not limited to, compact disks, DVD, musicassettes, videocassettes and the like, or for eyeglasses, or to be attached to pieces of clothing and the like.

These mechanisms are typically activated on the product to be protected when this latter one is exposed for being sold and are removed, generally through detaching devices, upon payment for the product itself.

What cannot be found in the prior art however is an anti-theft device that can be applied to any type and shape of bottle in such a way as to prevent possible thefts, and above all to dissuade, already visually, possible thieves, and that can be easily and quickly removed, as it happens for existing anti-theft mechanisms, through a suitable detaching device.

Moreover, there are particular situations in which it would be surely interesting to have available a safety mechanism that can be easily and practically used while being at the same time inexpensive, that prevents an accidental or unauthorised consumption of a bottle, such as, for example, the case in which such contents is a harmful substance, a drug or an alcoholic substance: such mechanism would therefore be extremely useful, for example, in domestic applications in which, rather too frequently, liquid detergents and various harmful substances (hydrocarbons, disinfectants, insecticides, alcoholic beverages) are arranged in anonymous bottles, to avoid an accidental or unauthorised consumption or use of such substances. Obviously, such mechanism would be better useful when there are children.

SUMMARY OF THE INVENTION

Therefore, object of the present invention is providing an anti-theft and safety mechanism that can be applied to any type of bottles and that can be easily and quickly removed by using a suitable detaching mechanism.

Another object of the present invention is providing an anti-theft and safety mechanism for bottles that, in general, prevents an unauthorised consumption or use of the contents (such as, for example, alcoholic beverages, drugs, harmful substances) of the bottles themselves.

The above and other objects and advantages of the invention, as will appear from the following description, are obtained by an anti-theft and safety mechanism for bottles as claimed in claim 1. Preferred embodiments and non-trivial variations of the present invention are claimed in the dependent Claims.

BRIEF DESCRIPTION OF THE DRAWINGS

The present invention will be better described by some preferred embodiments thereof, given as a non-limiting example, with reference to the enclosed drawings, in which.

DESCRIPTION OF THE PREFERRED EMBODIMENTS

Figure 1:
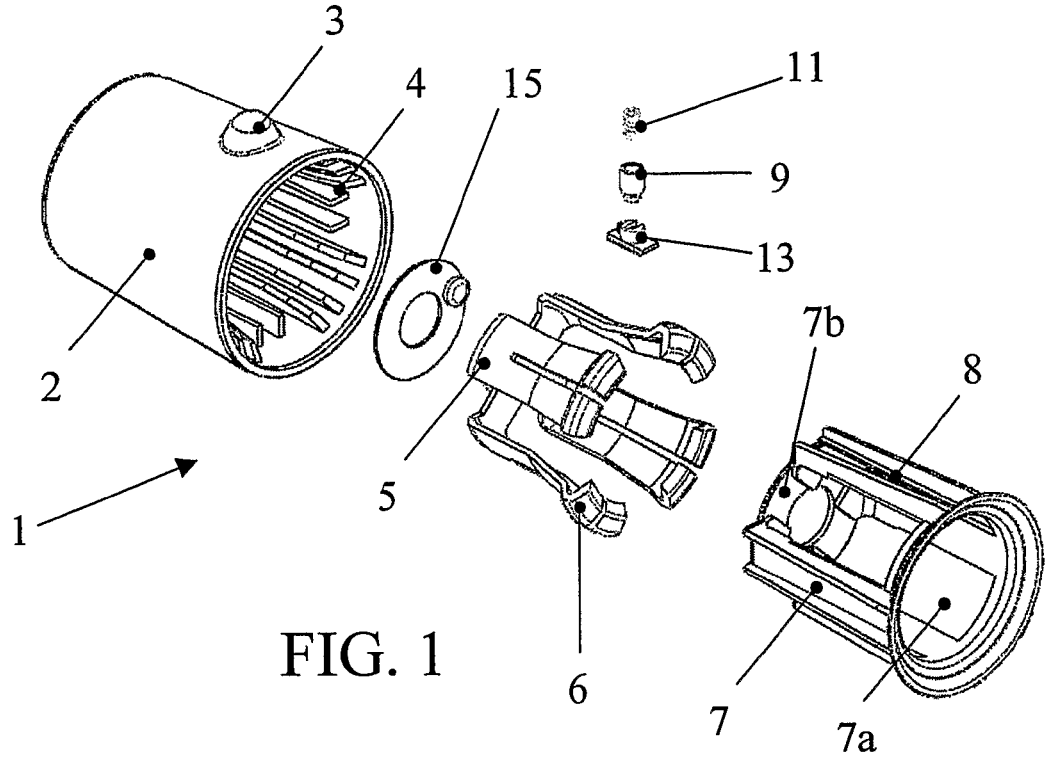
FIG. 1 is an exploded perspective view of an anti-theft and safety mechanism for bottles according to the present invention.

With reference to the Figures, a preferred, but not limiting, embodiment of the anti-theft and safety mechanism for bottles 1 of the present invention is shown. It will be immediately obvious to the skilled people in the art that numerous modifications and variations can be made to the described mechanism 1, without departing from the scope of the invention, as defined in the enclosed claims.

With reference to the preferred embodiment shown in the Figures, the anti-theft and safety mechanism 1 for bottles of the invention substantially comprises:

- an external support body 2;
- locking and unlocking means of the mechanism 1 operating transversally to a longitudinal axis of the support body 2, in which these locking and unlocking means are adapted to be magnetically attracted outside of the support body 2 in order to unlock the mechanism 1;
- means for securing the mechanism 1 onto a neck of a bottle (not shown).

Further, the anti-theft and safety mechanism 1 for bottles of the invention can be provided with a known alarm detecting system.

In particular, with reference to FIGS. 1 and 2, it is possible to note that, preferably, the locking and unlocking means are composed of one sliding pin 9, preferably made of iron but alternatively made of any other ferromagnetic material, coaxial with elastic means, preferably an helical spring 11, to which a locking saw-toothed slider 13, described below, is connected or of which it is an integral part.

The securing means are composed, in the present preferred embodiment, of two parts: a locking element 5 equipped with flexible locking wings 6 (in the Figures such wings are eight and are joined in pairs, but it is obvious that they could be in a different number and arranged differently, though keeping analogous functionalities of the present invention) containing and coaxial with a housing element 7 of the neck of the bottle, equipped with a saw-toothed rail 8 adapted to operatively cooperate with the locking saw-toothed slider 13 and with suitable slits 7*a* adapted to allow a passage of the locking wings 6. The above-described securing means are therefore contained inside the support body 2, are coaxial therewith and are adapted to longitudinally slide therein.

In particular, the support body 2 is internally equipped with particularly-shaped longitudinal wings 4 adapted to cooperate with the locking wings 6, as will be described below. Moreover, the support body 2 is equipped with a housing 3, having in particular a sliding seat 3*a* of the pin 9, adapted to house the locking and unlocking means and to allow the cooperation with a detaching device, particularly in the preferred embodiment a magnetic detaching device.

Figure 2:
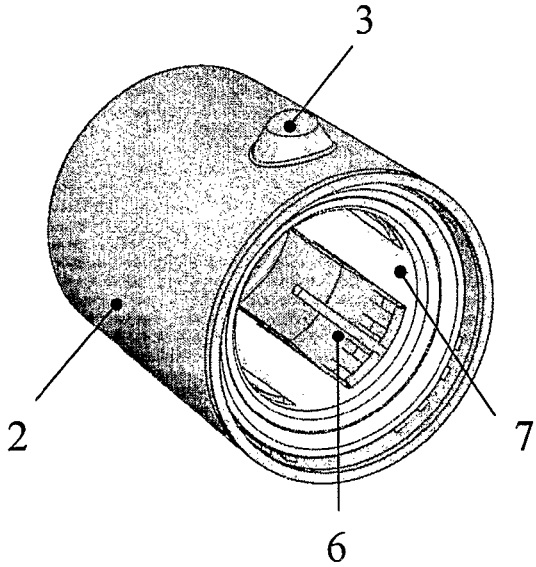
FIG. 2 shows a perspective view of the anti-theft and safety mechanism for bottles of FIG. 1 as assembled.

The alarm detecting system of the mechanism 1 is, for example, shown in FIG. 1 as a radio frequency device 15 known, but it is evident that the mechanism 1 can lodge any other detecting system known.

Figure 4:
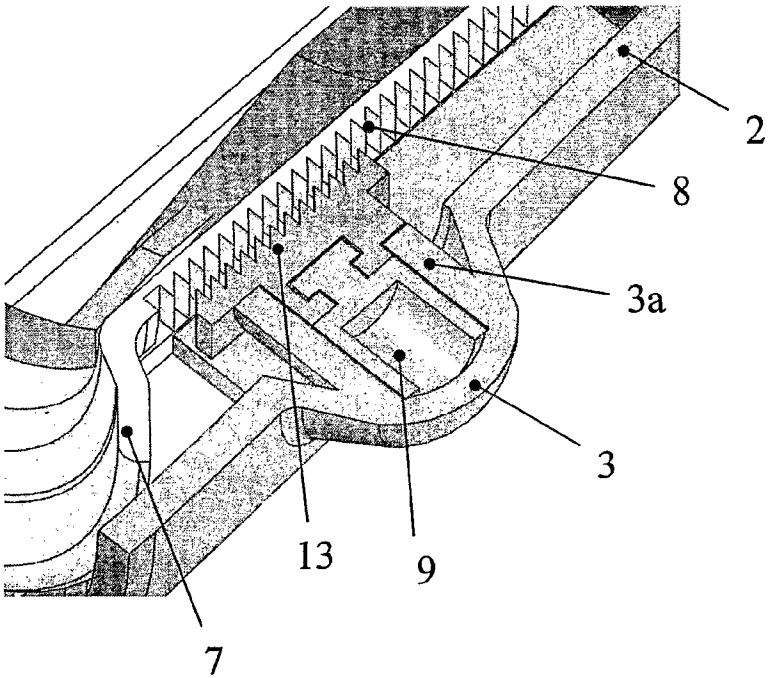
FIG. 4 shows another sectional view of the part of FIG. 3.
Figure 3:
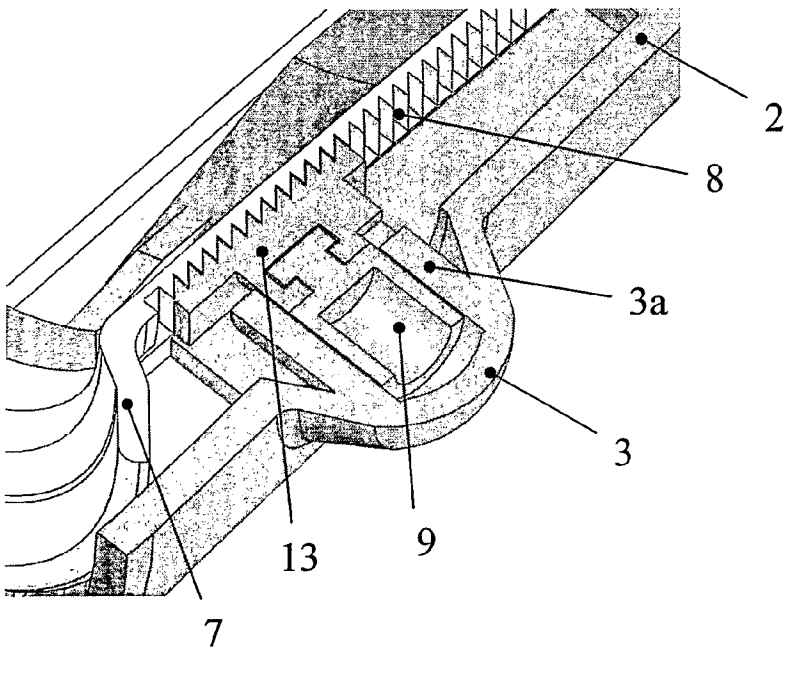
FIG. 3 shows a sectional view of a part of the anti-theft and safety mechanism for bottles according to the present invention.

With reference now to FIGS. 3 and 4, it is possible to note the interaction between the locking and unlocking means and the securing means. In particular, it is possible to note that the locking saw-toothed slider 13 and the saw-toothed rail 8 are equipped with a saw-toothing characterised by teeth whose shape is such that their respective related sliding is allowed if they are cooperating along one direction and their mutual locking is performed if they are cooperating along a reverse direction. The locking and unlocking means with respect to the securing means are characterised by two extreme positions: a first position (shown in FIG. 3) in which the saw-toothing of the locking saw-toothed slider 13, under the thrust action of the spring 11, engages the saw-toothing of the saw-toothed rail 8 and, given the shape of the saw-toothing as described above, prevents the relative sliding between the securing means and the support body 2; and a second position (shown in FIG. 4) in which the locking saw-toothed slider 13, under the action of a detaching device that magnetically operates on the pin 9 by attracting it, disengages the saw-toothed rail 8 allowing the relative sliding between securing means and support body 2.

With reference now to FIG. 5*a* to 7, it is possible to note some operating steps of the mechanism 1 according to the present invention. Tightening of the mechanism 1 on the bottle neck occurs through the thrust of the longitudinal wings 4 onto the locking wings 6 when the support body 1 and the securing means are mutually approaching through a relative sliding one with respect to the other.

Figure 5B:
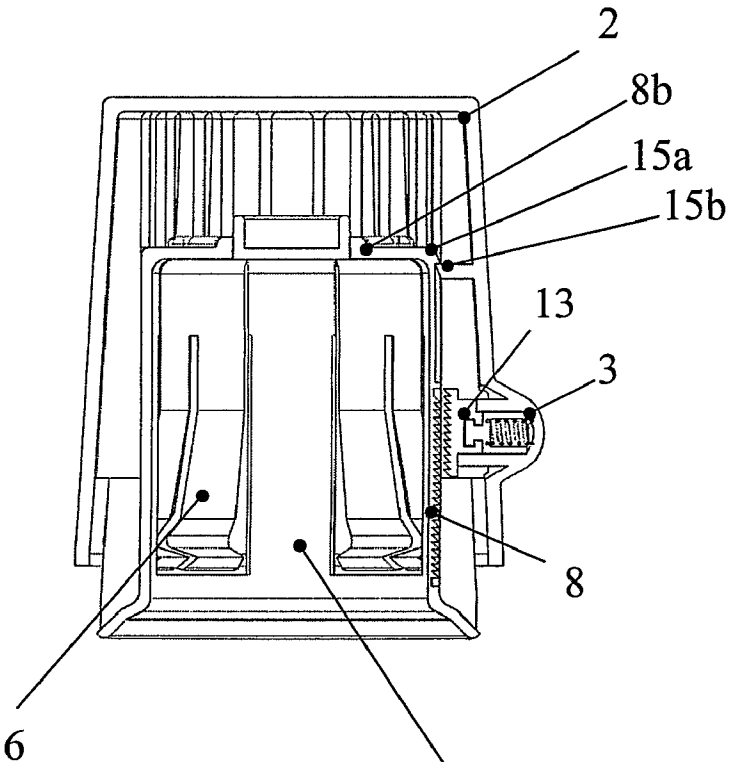
FIG. 5*b* shows another sectional view of the anti-theft and safety mechanism of FIG. 5*a;*
Figure 5A:
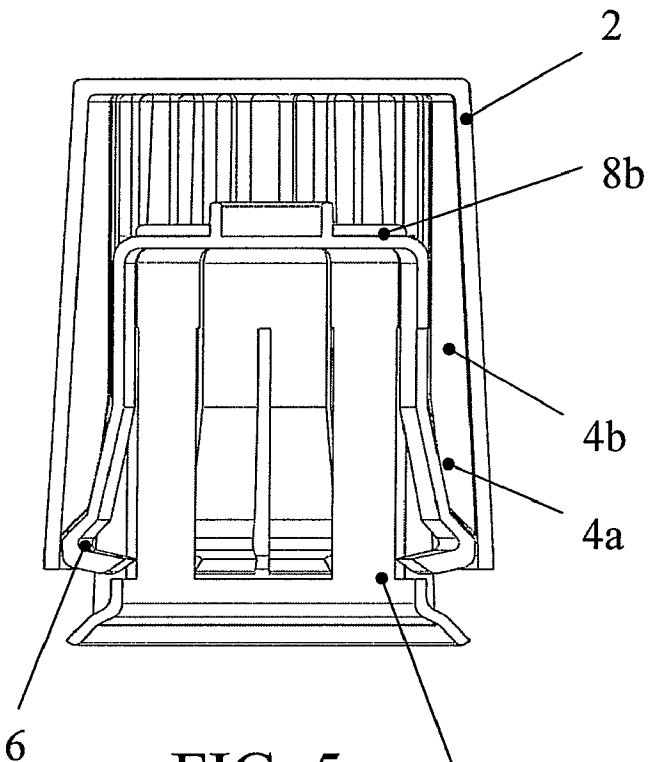
FIG. 5*a* shows a sectional view of an operating position of the anti-theft and safety mechanism for bottles according to the present invention.

In particular, FIGS. 5*a* and 5*b* show a position in which the mechanism 1 is unlocked and ready for the operating positioning onto a bottle: in such position, the support body 2 and the securing means are relatively spaced apart one from the other and the locking wings 6 are open and possibly abutting onto a tapered position 4*a* of the longitudinal winds 4. In such position, the securing means are prevented from going out of the support body 2 preferably by a first end-of-stroke stop 15*a* of the securing means abutting onto a second end-of-stroke stop 15*b* of the support body 2.

Figure 6:
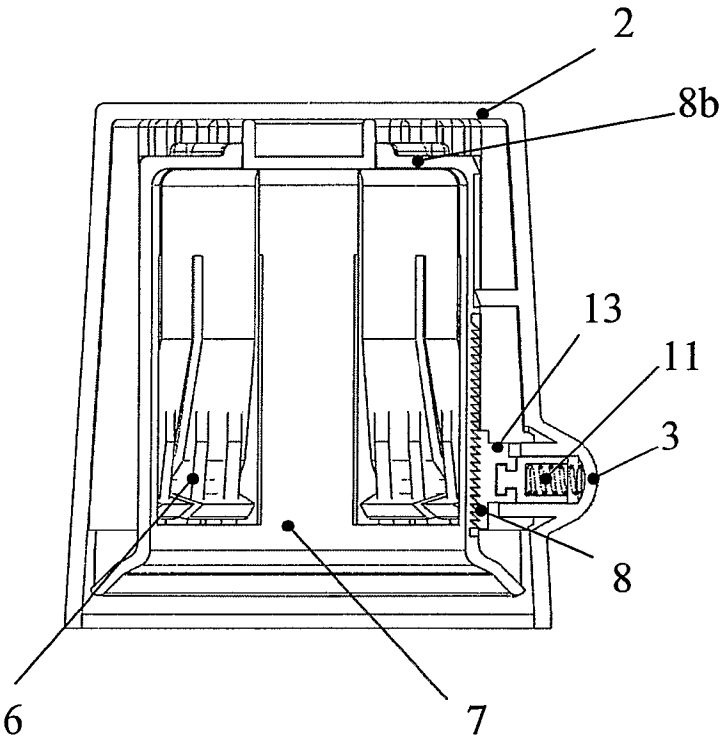
FIG. 6 shows a sectional view of another operating position of the anti-theft and safety mechanism for bottles according to the present invention.

With reference to FIG. 6, it is possible to note the mechanism 1 according to the present invention as locked: in such position, in fact, deriving from the relative approach between securing means and support body 2, the locking wings 6 have been pushed and flexed towards the inside of the securing means from a narrowed position 4*b* of the longitudinal wings through the slits 7*a* in order to come in contact with the neck of a bottle and lock the mechanism 1 onto itself due to the locking and unlocking means being in their first position as above. The approach between securing means and support body 2 is obviously generated, during the operating positioning of the mechanism 1 onto a bottle, by the abutment between the plugging portion of the bottle neck with the upper ceiling 7*b* of the securing means as consequence of a mechanical thrust, for example by an operator, of the mechanism 1 towards the bottle that generates the approach and the relative sliding between securing means and support body 2 and the consequent relative sliding between saw-toothed rail 8 and locking saw-toothed slider 13 till the flexure of the locking wings 6 is not stopped by the bottle neck and the locking and unlocking means, being naturally in their first position, lock any other relative movement between securing means and support body 2, thereby locking the mechanism 1 onto the bottle. It is clear that the particular arrangement of the saw-toothing that has been previously mentioned and the action of the spring 11 onto the saw-toothed slider 13, and consequently on the saw-toothed rail 8, prevent the removal of the mechanism 1 from the bottle without the intervention of a detaching device that operates on the locking and unlocking means.

Figure 7:
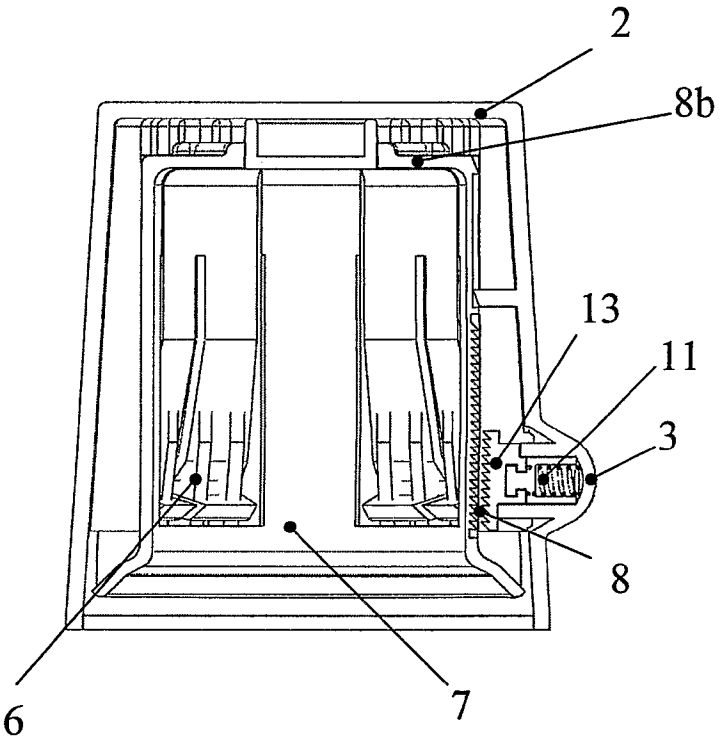
FIG. 7 shows a sectional view of another operating position of the anti-theft and safety mechanism for bottles according to the present invention.

With reference then to FIG. 7, it is possible to note a step of unlocking of the mechanism 1: by using a magnetically-operating detaching device it is possible, by attracting the pin 9 through the housing 3, to disengage the locking saw-toothed slider 13 of the saw-toothed rail 8, thereby again allowing a relative sliding between securing means and support body 2 and the removal of the mechanism 1 from the bottle.

It is clear that the locking and unlocking means, instead of having a magnetic operation, could mechanically or electrically/electronically operate, associated with a suitable detaching device, even integrated into the mechanism 1 itself, without departing from the scope of the present invention.

It is further clear that, by suitably arranging the sizes of the various components of the mechanism 1 according to the present invention, particularly the support body 2 and the securing means, it is possible to use the mechanism 1 with any type and shape of commercially existing bottles.

As already previously described, the advantageous applications of the present invention are numerous: in fact, in addition to having wide chances of use in commercial activities for preventing and dissuading thefts while guaranteeing a simple and practical use both during its operating positioning and during its removal, due to being inexpensive in its realisation that is clear from what has been described above, it can found a wide application also in domestic or industrial fields to prevent the accidental or unauthorised used of certain substances.

The invention claimed is:

1. An anti-theft and safety mechanism for bottles comprising:

a) an external support body;

b) locking and unlocking means, said locking and unlocking means operating transversally to a longitudinal axis of the support body, said locking and unlocking means being adapted to be magnetically attracted outside the support body in order to unlock the anti-theft and safety mechanism, the locking and unlocking means comprising at least one sliding pin made of ferromagnetic material cooperating with elastic means and connected to a locking saw-toothed slider, the locking and unlocking means being contained in a housing projecting from outside the support body; and c) means for securing the anti-theft and safety mechanism onto a neck of a bottle, the means for securing comprising a locking element comprising and coaxial with a housing element of the neck of the bottle, the locking element being equipped with flexible locking wings, the housing element being equipped with a saw-toothed rail adapted to operatively cooperate with the locking saw-toothed slider and with slits adapted to allow the locking wings to pass therethrough; and wherein the support body is internally equipped with longitudinal wings adapted to cooperate with the locking wings, each one of the longitudinal wings being equipped with a tapered portion and with a narrowed portion.

2. A mechanism of claim 1, wherein the external support body is adapted to coaxially comprise the securing means and to slide with respect to the securing means.

3. A mechanism of claim 1, wherein the pin comprises iron.

4. A mechanism of claim 1, wherein the elastic means comprises a helical spring coaxial to the pin.

5. A mechanism of claim 1, wherein the locking and unlocking means are adapted to cooperate with a detaching device.

6. A mechanism of claim 1, wherein the mechanism comprises an alarm detecting system.

7. A mechanism of claim 6, wherein the alarm detecting system is a radio frequency device.

* * * * *